US005292455A

United States Patent [19]

Zefferi et al.

[11] Patent Number: 5,292,455

[45] Date of Patent: Mar. 8, 1994

[54] CORROSION INHIBITION OF CALCIUM CHLORIDE BRINE

[75] Inventors: Suzanne M. Zefferi, Morrisville; Roger C. May, Glenside, both of Pa.

[73] Assignee: Betz Laboratories, Inc., Trevose, Pa.

[21] Appl. No.: 23,249

[22] Filed: Feb. 25, 1993

[51] Int. Cl.[5] ..... C23F 11/10

[52] U.S. Cl. ..... 252/389.23; 252/389.2; 252/180; 252/70; 252/71; 252/78.5; 422/7

[58] Field of Search ..... 106/14.12; 252/389.2, 252/389.23, 180, 181, 70, 71, 78.5; 422/7, 15

[56] References Cited

U.S. PATENT DOCUMENTS

| | | | |
|---|---|---|---|
| 4,649,025 | 3/1987 | Hwa et al. | 252/389.23 |
| 4,689,200 | 8/1987 | Cook et al. | 252/389.23 |
| 4,849,171 | 7/1989 | Murray | 422/7 |
| 5,068,059 | 11/1991 | Go et al. | 252/389.53 |

*Primary Examiner*—Anthony Green

*Attorney, Agent, or Firm*—Alexander D. Ricci; Steven D. Boyd

[57] ABSTRACT

A method of inhibiting corrosion of metals such as low carbon steel in contact with calcium chloride brine comprising adding to the brine or to the salt prior to dissolution 2-hydroxyphosphono-acetic acid.

3 Claims, No Drawings

CORROSION INHIBITION OF CALCIUM CHLORIDE BRINE

FIELD OF THE INVENTION

The present invention relates to the inhibition of corrosion in the presence of calcium chloride brine. More particularly, the present invention relates to the inhibition of low carbon steel corrosion in contact with calcium chloride brine.

BACKGROUND OF THE INVENTION

Calcium chloride is a widely used industrial chemical. Significant volumes are used as a curing accelerator in concrete, as an additive in drilling muds to control density and clay flocculation, as a drainage aid in paper mills, as a dessicant in refrigeration plants, and as a heat transfer fluid in closed recirculating cooling systems operating at temperatures below zero degrees C.

Calcium chloride brines in applications such as for concrete accelerators or as additives to drilling muds create serious corrosion problems. Most construction concrete is reinforced with steel bars which are embedded in the concrete and the presence of calcium chloride in the concrete accelerates corrosive attack of the reinforcing steel. The calcium chloride in drilling muds causes an accelerated corrosion of well tubing and equipment used in oil drilling applications. The use of calcium chloride as a drainage aid in the paper industry has been limited by the corrosive nature of its solutions.

In closed recirculating cooling systems where calcium chloride brine is employed as a heat transfer medium, corrosion control is necessary. Historically, chromates have been used to inhibit corrosion in calcium chloride brine systems. Chromates are soluble in these concentrated solutions and are extremely efficacious in these aggressive environments. However, the environmental and health concerns that the use of chromates presents have resulted in their being phased out as corrosion inhibitors. Nitrites are also soluble and compatible in calcium chloride brines and have been employed as a replacement for chromates. However, high levels of nitrite, that is up to 0.5%, are necessary for corrosion protection in calcium chloride brine systems.

SUMMARY OF THE INVENTION

The present invention comprises a method of controlling corrosion in calcium chloride brine systems in which an effective amount of corrosion inhibitor is added to the calcium chloride brine. The corrosion inhibitor comprises 2-hydroxyphosphono-acetic acid. The 2-hydroxyphosphonoacetic acid is preferably present in the brine solution in concentrations of from about 240 to 1000 parts per million parts brine. Typically such brine solutions are up to about 30% calcium chloride. The inhibitor of the present invention has been found to be an effective corrosion inhibitor for low carbon steel exposed to calcium chloride brine. The efficacy of 2-hydroxyphosphonoacetic acid is unexpected in light of the limited efficacy of hydroxyethylidenediphosphonic acid (HEDP).

DESCRIPTION OF THE PREFERRED EMBODIMENT

The present invention comprises a corrosion inhibited composition of calcium chloride brine which contains 2-hydroxyphosphonoacetic acid. 2-hydroxyphosphonoacetic acid has been found to be an efficacious corrosion inhibitor in calcium chloride brine. The corrosion inhibitor of the present invention has been found to be particularly efficacious for calcium chloride brines in contact with low carbon steel.

The inhibitor is present in the calcium chloride brine in concentrations of from about 240 to 1000 parts per million and preferably from about 240 to 500 parts per million. The inhibitor may be added directly to the brine, or the inhibitor may be added to the dry salt so that it is present when the salt is dissolved in water.

The following example describes the corrosion inhibition which is achieved with the calcium chloride and 2-hydroxyphosphonoacetic acid solution of the present invention.

EXAMPLE

Testing was conducted in a beaker corrosion test apparatus. Low carbon steel corrosion probes and coupons were employed. Corrosion rates were determined electrochemically using linear polarization. The pH of the 25% calcium chloride brine test solution was adjusted to 8.4 with NaOH prior to testing. The final pH of the sample solution equilibrated to about pH 7.5. Tests were conducted at 60° C. Table I summarizes the results.

TABLE I

| Inhibitor | Concentration (ppm) | Corrosion Rate (mpy) |
|---|---|---|
| Blank | — | 100 |
| 2-Hydroxyphosphonoacetic acid | 500 | 17 |
| Hydroxyethylidenediphosphonic acid (HEDP) | 500 | 45 |

The test data show that the composition of the present invention is significantly more effective than HEDP at inhibiting corrosion in calcium chloride brine solutions.

Testing of low carbon steel corrosion in calcium chloride brine solutions was also undertaken wherein known cooling water corrosion inhibitors were tested in calcium chloride brine. The corrosion inhibitors tested comprised a phosphorous balanced alkaline treatment and a zinc balanced alkaline treatment. The phosphorus balanced alkaline treatment consisted of an orthophosphate, polyphosphate, azole and HPSI polymer treatment available as Continuum ® from Betz Laboratories, Inc., of Trevose, Pa. At a concentration of 1000 ppm in the above procedure, the corrosion rate averaged 55 mpy for 3 separate runs. The zinc balanced alkaline treatment consisted of an HEDP, azole, zinc and HPSI polymer treatment available as BAT zinc from Betz Laboratories, Inc. At a concentration of 1000 ppm in the above procedure, the corrosion rate averaged 64 mpy over 3 runs. HPSI is an acrylic acid/allyl hydroxypropyl sulfonate ether copolymer available from Betz Laboratories, Inc. The data shows that the present invention is significantly more effective than prior art cooling water corrosion control treatments.

While the present invention has been described with respect to particular embodiments thereof, it is apparent that numerous other forms and modifications of the invention will be obvious to those skilled in the art. The appended claims and this invention generally should be construed to cover all such obvious forms and modifications which are within the true spirit and scope of the present invention.

We claim:

1. A method of inhibiting corrosion of metal surfaces in contact with calcium chloride brines comprising adding to a calcium chloride brine an inhibitor comprising 2-hydroxyphosphonoacetic acid in amounts from about 240 to 1000 parts per million.

2. A composition of calcium chloride brine which includes a sufficient amount of 2-hydroxyphosphonoacetic acid to inhibit corrosion of low carbon steel in contact with said composition.

3. The composition of claim 2 wherein the concentration of 2-hydroxyphosphonoacetic acid is from about 240 to 1000 parts per million.

* * * * *